United States Patent [19]

Kunevicius

[11] 4,433,500

[45] Feb. 28, 1984

[54] GUN GLOVE

[76] Inventor: Raymond A. Kunevicius, 6115 Elmwood Ave., Independence, Ohio 44131

[21] Appl. No.: 342,378

[22] Filed: Jan. 25, 1982

[51] Int. Cl.[3] ..... F41C 27/00

[52] U.S. Cl. ..... 42/1 N; 42/74

[58] Field of Search ..... 42/1 N, 1 R, 74, 71 R

[56] References Cited

U.S. PATENT DOCUMENTS

| | | | |
|---|---|---|---|
| 1,973,811 | 9/1934 | Jessup | 42/74 |
| 2,193,310 | 3/1940 | Brant | 42/74 |
| 2,364,340 | 12/1944 | Bogg, Jr. | 42/1 N |
| 3,299,558 | 1/1967 | Karl | 42/1 N |
| 3,574,965 | 4/1971 | Seiger | 42/1 N |
| 3,665,990 | 5/1972 | Hefner, Jr. | 42/1 N |
| 4,120,108 | 10/1978 | Vickers et al. | 42/74 |

*Primary Examiner*—Charles T. Jordan

*Attorney, Agent, or Firm*—Robert Bruce Henn

[57] ABSTRACT

Means for protecting non-metallic and decorative metallic portions of a long gun are disclosed. The means comprises a flexible cover having an elastic portion, fastening means and an opening for the functional mechanism, and permits the gun to be used with the cover in place.

9 Claims, 4 Drawing Figures

GUN GLOVE

BACKGROUND OF THE INVENTION

1. Field of the Invention

The present invention is in the field of protective devices for firearms. More specifically, this invention is in the field of covers for long guns.

2. Description of the Prior Art

Sportsmen who use guns for hunting or target shooting frequently have invested substantial sums in the firearm; often a large part of the investment is in the stock and decorative work on the metal parts of the gun. In order to protect these areas from marring, the guns are kept in locked cabinets when not in use, and transported in boxes or scabbards to the site.

In the case of pistols, the likelihood of damage to non-functional parts during use is minimal; the pistol is in either a holster or the user's hand when at the ready or in use. In the case of a long gun, however, it has not heretofore been possible conveniently to transport the gun, have it available for ready use, and protect the non-functional or decorative parts from damage. As used in this specification, the term "long gun" refers to rifles, shotguns, muskets and the like, such firearms being characterized generally by a barrel with a length greater than about 25 centimeters (cm), and having a stock of length in excess of about 15 cm, as opposed to a simple handgrip.

Specifically with respect to long guns, a hunter can transport his gun to or near the site where he will be hunting, leaving the gun in its protective case until the time it is used. However, once out of the case, the gun is now susceptible to scratching, nicks, abrasion and other kinds of disfiguring damage by virtue of being carried through and over fences, thorns, branches, stones, barriers and the like, both natural and man-made. Similarly for target shooting, the gun is kept in the case until used, but is still exposed to damage during use, when the stock, slide, forearm and other parts can be injured in a varity of ways. As a result of this situation, and because of the considerable investment which many sportsmen have made in rifles and shotguns, it is a common phenomenon to find a sportsman using an expensive gun for practice, and a lower-cost firearm for field use, either in hunting or target practice. Because each gun has individual idiosyncracies, the practice on the gun may not be fully tranferable to another. As a result, efficiency in the field suffers. A desirable solution to this situation would be a gun cover which both protects the gun and at the same time permits it to be used in the field with reasonable convenience.

While there are any number of methods to protect guns from damage, virtually none of them permit the gun to be operated in a normal fashion while the protective means is in place. One partial answer to the problem is provided by Heffner in U.S. Pat. No. 3,665,990. Heffner discloses a stock protector with flexible side panels and a closure means for maintaining the protector in close relationship with the stock.

However, Heffner's device makes no provision for the working parts of the gun; it does not extend to the trigger area or the forearm. By Heffner's disclosure, a lever-action gun equipped with his cover would be unworkable; further, his fastener would cause irritation or interference with the sighting of the gun by impinging on the cheek of the user; in the models of some guns, the fastener can interfere with sighting.

Another device disclosed by Stackhouse, U.S. Pat. No. 3,701,371, shows a scabbard with openings through which the trigger may be operated and bullets ejected. The scabbard covers virtually the entire gun, but has no provision to permit sighting or cocking, and interferes with normal handling.

A protective cover for a long gun, to be fully effective, should cover the wooden and decorative metal parts and keep them from being scratched, nicked and abraded, but at the same time permit unimpeded operation of all of the functions of the gun. The cover should also be easy to attach and remove, and should not add unduly to the weight of the gun. No device meeting all these criteria has heretofore existed.

When appropriate, a cover for a gun should afford low visibility to the gun in, e.g., hunting situations, where the glint of sun on metal or highly polished woodwork might betray the presence of a hunter. Further, a cover on a rifle can have military applications in addition to protection of a hunter's or sportsman's gun against minor damage. The current use of tape or paint to achieve either or both of these functions is only marginally effective, whether in sporting or military application, due to the ease with which the covering material can wear off.

SUMMARY OF THE INVENTION

This invention comprises a flexible cover for a long gun, the cover having an elastic portion and fastening means, and being provided with an opening for the functional mechanism of the gun; the construction of the cover permits the gun to be used without removing the cover from the gun.

DESCRIPTION OF THE PREFERRED EMBODIMENTS

The preferred emboiment of the present invention is a flexible cover for a long gun, the cover having at least one flexible portion and at least one fastening means, and being provided with at least one opening for the functional mechanism of the gun. The cover can comprise a plurality of pieces, or can be unitary, depending on the mechanism of the gun.

Figures 1, 3:
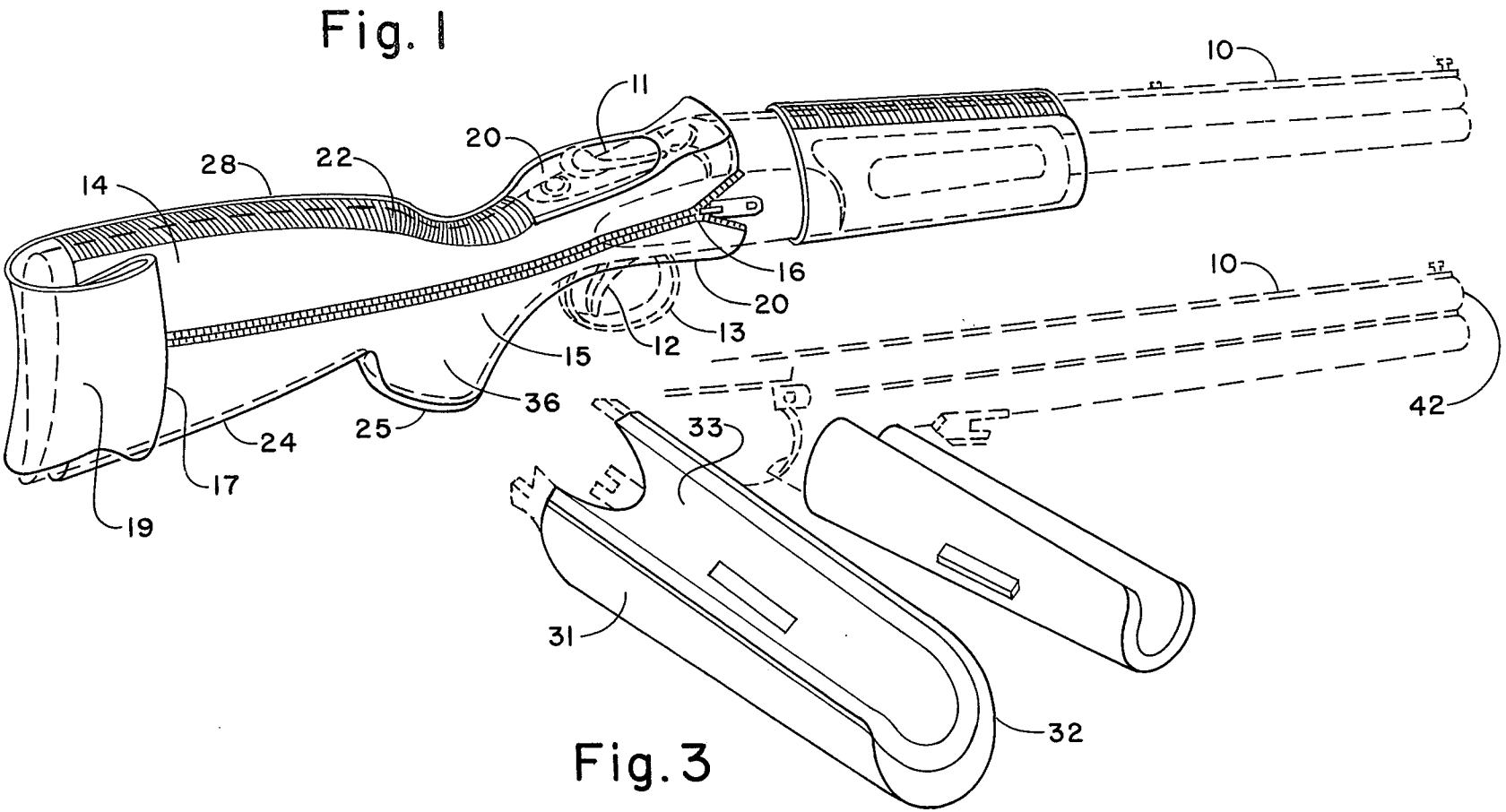
FIG. 1 is a view in perspective of a long gun with the protective cover in place.
FIG. 3 shows the slide of a shutgun with the cover for that portion affixed.

FIG. 1 shows a long gun; in this case, an over-and-under shotgun indicated generally at 10, with one embodiment of the present invention affixed. Gun 10 has release 11 on the top portion and trigger 12 and guard 13 on the bottom.

Cover 14 fits snugly over stock 15, and is preferably made of a flexible, abrasion-resistant material, such as, e.g., plasticized poly(vinyl chloride) fabric or the like. First fastening means 16 holds cover 14 securely in place on stock 15. Second fastening means 17 secures flap 19 to one face of cover 14; flap 19 covers butt 18, shown in FIG. 2. For esthetic and practical considerations, the cover can be colored to match or complement the gun, or can be given a camouflage or protective coloration to reduce visibility in the field. The reduction in visibility applies not only in situations where the gun is at rest, but also when the gun is brought up for aiming. A camouflage pattern tends to break up the regular outline of the gun, and thus tends to conceal motion. This aspect is especially utilitarian in hunting or military situations.

Cover 14 is provided with openings shown as 20 in FIG. 1. Openings 20 permit various functional parts of the gun such as e.g., release 11 and trigger 12 to be operated without removal of the cover yet without interference with the mechanism of the gun. Further, openings 20 are preferably provided with an elastic to keep them closed around the functional part while permitting the part to operate properly. Those skilled in the art will realize that openings 20 are not restricted to the parts shown, but can include also provisions for sights, bolts, magazines, ports and other parts of the gun where a covering would interfere with its operation in the field. Thus, FIG. 1 is illustrative of this facet of the invention, rather than limiting, to avoid burdensome detail in the drawing.

Figures 2, 4:
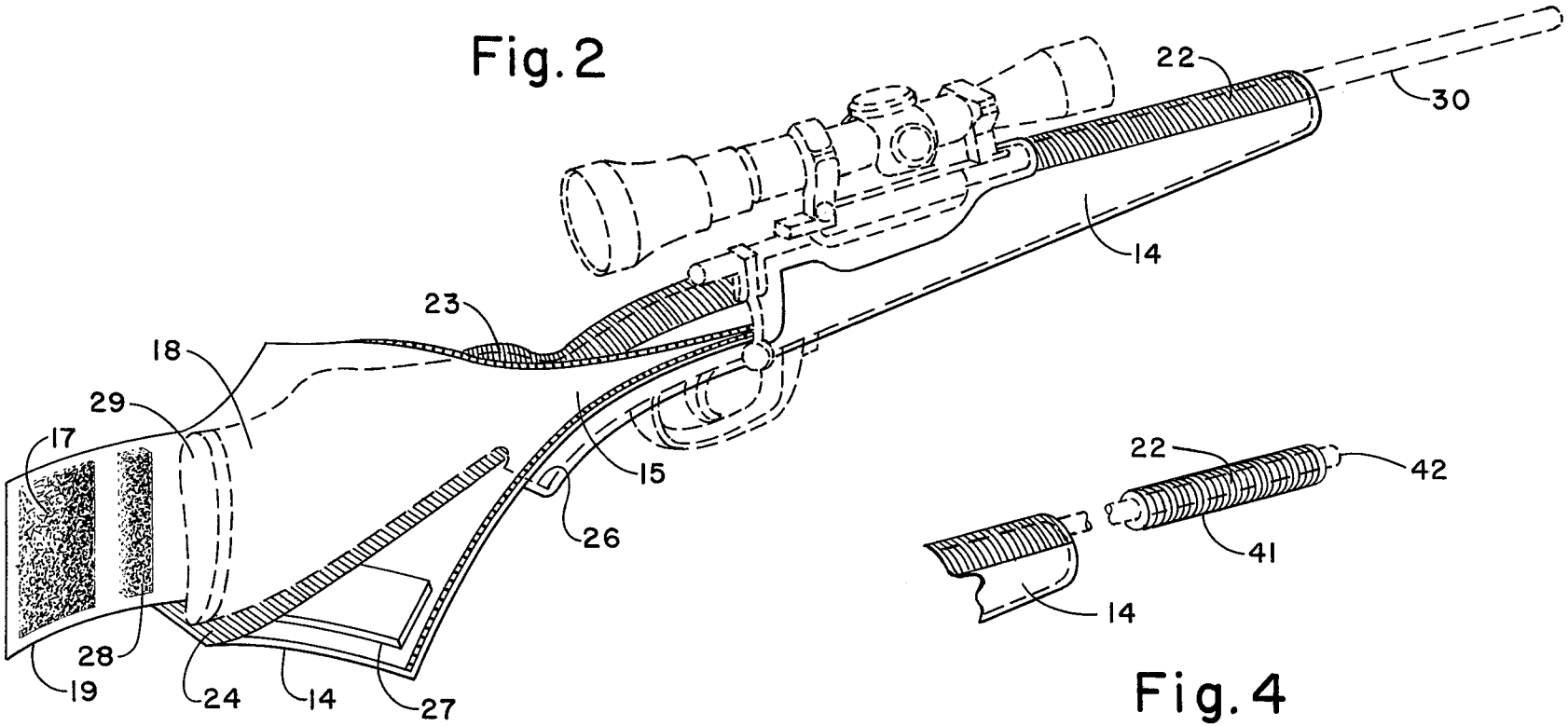
FIG. 2 is a perspective view of a long gun with the cover partially affixed.
FIG. 4 shows a rifle with all parts covered.

First elastic portion 22 covers the comb of stock 15; comb 23 is shown in FIG. 2. Second elastic portion 24 is juxtaposed along the bottom portion of stock 15. The elastic portions 22 and 24 permit the cover to fit closely to the covered parts of the gun, thus affording it protection against abrasion and minor damage while retaining substantially the contours of the gun. An unexpected feature discovered from the use of multiple elastic portions is that one style of cover is sufficient to provide utilitarian protection for a variety of guns. In this fashion, the number of styles is minimized.

An example of the latter feature can be seen by reference to the differing styles of stocks 15 illustrated in FIGS. 1 and 2. FIG. 1 shows a shotgun 10 while FIG. 2 shows a rifle 30. The stock of the rifle has a high comb and a standard grip 26; the shotgun in FIG. 1 has a standard comb and a modified, or deep, grip 25. By providing multiple elastic portions, both styles can be accommodated by one style of cover.

First fastening means 16 is located on the fastener side 36 of cover 14. The fastener side, and therefore fastening means 16, is designed to be on the side of stock 15 which is away from the cheek of the operator. By this arrangement, fastening means 16 does not interfere with the operator of the gun or with the function of the gun.

Second fastening means 17 is similarly disposed to be away from the cheek of the operator when fastened on the gun, for the same reasons as set forth hereinabove. Fastening means 17 is conveniently and preferably composed of mating loop-pile fabric and hook-shaped fibers, juxtaposed in the closed, or fastened, position, by pressing the two portions together, and opened by peeling one portion from the other. This style of fastener permits adjustment further to that provided by the multiple elastic portions, and allows the cover to conform to butt plate 29 in whatever style it may be encountered. Further, if a gun with an existing cover is modified by, e.g., replacement of the butt plate with a cushioned plate, no change in the cover is necessary.

Storage or container means 27 is shown in FIG. 2 juxtaposed at the butt end of cover 14. Storage means 27 can be a general pocket, or a particular type of means, such as a cartridge or shell holder. In the embodiment illustrated in FIG. 2, storage means 27 is a flap which can be secured on three sides by the action of flap 19 and fastening means 17. Various items such as, e.g., a hunting license or matches can be stored therein.

Another embodiment of the present invention employs padding in the butt area to help in cushioning the shoulder of the operator from recoil. In FIG. 2, padding 28 is shown affixed to flap 19, juxtaposed to cause it to bear against butt plate 29 when fastened.

Because of the many styles of long guns, it is not possible to make one cover that will fit every gun. For instance, rifle 30 shown in FIG. 2 has a stock which extends approximately two-thirds of the total length of the gun, while the stock of shotgun 10 is somewhat shorter than that. FIG. 3 shows the forearm 31 of a shotgun with auxiliary cover 32 affixed to it. Auxiliary cover 32 is provided with thin elastic material 33 on one surface. The thin elastic material permits auxiliary cover 32 to be affixed, and conform, to the forearm, and still permit the forearm to slide with respect to the barrel of the shotgun. FIGS. 2 and 3 show barrel 42 on rifle 30 and gun 10, respectively.

While the cover of the present invention affords mechanical protection and protective coloration when desired, it additionally provides a measure of thermal protection for the user of the gun. For instance, a hunter or soldier in conditions of very cold weather can handle a gun without concern for the contact of exposed metal or wood with bare skin on, e.g., his face or hand.

A further advantageous military factor secured with the present invention, beyond the provision of low visibility, is the reduction of noise associated with bare metal or wood coming into contact with other hard objects. The cover significantly reduces the chances of such contact, and thereby reduces undesired noise for maneuvers such as night patrol or commando-type operations.

FIG. 4 shows rifle 30 with cover 14 in place, covering the entire stock of the gun. Barrel cover 41 covers barrel 42 In the embodiment shown, cover 14 is separate from barrel cover 41; however, those skilled in the art will realize that the cover can be unitary or in multiple components without departing from the spirit and scope of the invention Modifications, changes and improvements to the preferred shape and forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited to the advance by which the invention has promoted the art.

I claim:

1. A cover for a long gun having a stock with a comb and a bottom portion, said cover consisting of a flexible, abrasion-resistant material having a first elastic portion covering said comb, a second elastic portion covering said bottom portion, first fastening means, second fastening means, and at least one opening in said cover, said opening being provided with elastic.

2. The cover of claim 1 wherein said cover comprises a plurality of pieces.

3. The cover of claim 1 having additional fastening means.

4. The cover of claim 1 wherein said cover has a plurality of openings.

5. The cover of claim 1 wherein at least one of said fastening means comprises mating loop-pile fabric and hook-shaped fibers.

6. The cover of claim 1 wherein said first fastening means is disposed on the fastener side of said cover.

7. The cover of claim 1 having protective coloration.

8. The cover of claim 1 having storage means.

9. The cover of claim 1 having cushioning means.

* * * * *